United States Patent [19]

Raasch et al.

[11] 4,385,488

[45] May 31, 1983

[54] OPEN-END SPINNING DEVICE

[75] Inventors: Hans Raasch, Monchen-Gladbach; Jakob Lenzen, Korschenbroich; Klaus Pohl, Monchen-Gladbach, all of Fed. Rep. of Germany

[73] Assignee: W. Schlafhorst & Co., Monchen-Gladbach, Fed. Rep. of Germany

[21] Appl. No.: 247,650

[22] Filed: Mar. 26, 1981

[30] Foreign Application Priority Data

Mar. 29, 1980 [DE] Fed. Rep. of Germany ..... 3012314

[51] Int. Cl.[3] ..... D01H 1/135; D01H 7/882

[52] U.S. Cl. ..... 57/417; 57/404; 57/416

[58] Field of Search ..... 57/400, 404, 406, 408, 57/413, 414, 416, 417, 355

[56] References Cited

U.S. PATENT DOCUMENTS

| | | | |
|---|---|---|---|
| 3,640,061 | 2/1972 | Landwehrkamp | 57/417 |
| 3,805,505 | 4/1974 | Schuster | 57/417 |
| 3,834,147 | 9/1974 | Havranek et al. | 57/417 |
| 3,844,100 | 10/1974 | Croasdale et al. | 57/417 |
| 4,068,456 | 1/1978 | Landwehrkamp | 57/417 |
| 4,110,961 | 9/1978 | Havel et al. | 57/417 |

*Primary Examiner*—Donald Watkins

*Attorney, Agent, or Firm*—Herbert L. Lerner; Laurence A. Greenberg

[57] ABSTRACT

Open-end spinning device, including a rotor housing, a spinning rotor disposed in the rotor housing, a housing cover having a fiber feeding channel formed therein being in communication with the rotor, a thread delivery channel disposed in the cover, and a thread delivery orifice being at least partly disposed in the cover and being in communication with the thread delivery channel and rotor, the orifice having a hard and wear-resistant surface layer at thread deflection locations, the surface layer having areas of different wearability distributed therein.

8 Claims, 2 Drawing Figures

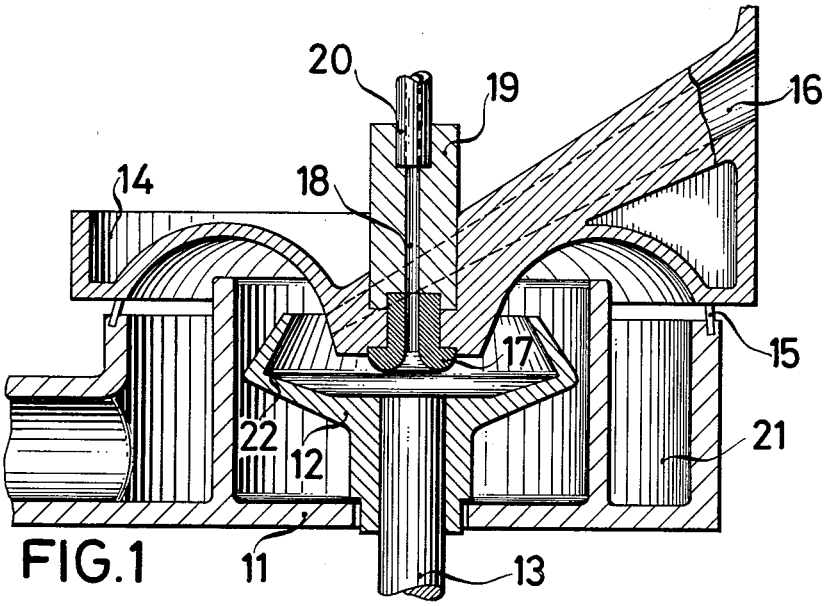
FIG.1
FIG. 2
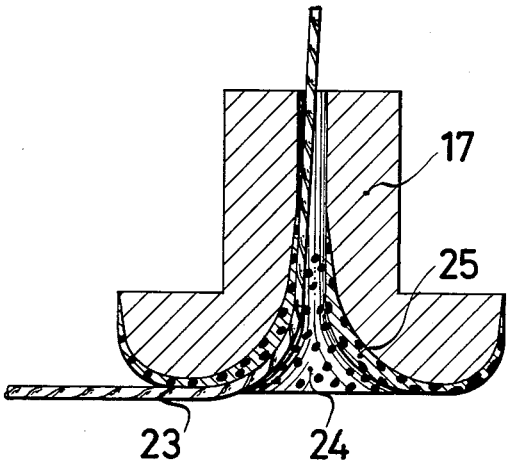

OPEN-END SPINNING DEVICE

The invention relates to an open-end spinning device including a rotor housing, a spinning rotor disposed in the rotor housing, a housing cover which contains a fiber feeding channel, a thread delivery orifice and a thread delivery channel, whereby the thread delivery orifice is provided with a hard and wear-resistant surface at the places where it deflects the thread to a different direction.

In rotor-spinning devices of this type, the thread in the thread delivery orifice is directed in a different direction than the direction in which it previously travelled. This deflection is approximately at a right angle. The thread slides at a high speed through the thread delivery orifice. The thread forces acting on the thread delivery orifice are dependent on the number of rotations of the rotor, the rotor diameter, and the nature of the thread. The force of the thread, and the high velocity of the thread cause excessive wear at the places where the thread is deflected into a different direction. Because the form and surface structure of the thread delivery orifice has great influence on the structure of the spun thread, and on the stability of the spinning operation, the optimal form and surface property of the thread delivery orifice, which is established by experimentation, should not be allowed to be changed by excessive wear.

In the known open-end spinning devices, considerable changes in the surface structure of the thread delivery orifice have been encountered due to wear at the places where the thread touches the surface. For example, wear has had the effect that a previously smooth surface has been roughened in an uncontrollable manner, or that artificially provided uneven spots have been flattened by wear.

It is accordingly an object of the invention to provide an open-end spinning device which overcomes the hereinafore-mentioned disadvantages of the heretofore-known devices of this general type, and to make certain that no change of the surface structure, and surface property of the thread-delivery orifice, occur during the spinning operation, so that, in a broader sense, a thread of uniform property is produced, and the stability of the spinning operation is maintained.

With the foregoing and other objects in view there is provided, in accordance with the invention, an open end spinning device, comprising a rotor housing, a spinning rotor disposed in the rotor housing, a housing cover having a fiber feeding channel formed therein being in communication with the rotor, a thread delivery channel disposed in the cover, and a thread delivery orifice being at least partly disposed in the cover and being in communication with the thread delivery channel and rotor, the orifice having a hard and wear-resistant surface layer at thread deflection locations, the surface layer having areas of different wearability distributed therein.

In accordance with another feature of the invention, the areas of different wearability are insular granular islands having distinct boundaries.

In accordance with a further feature of the invention, the surface layer has pores formed therein forming the areas of different wearability.

Because the surface coating has pores, or insular material spots which are limited by the grain boundaries, new pores are opened during the slow wear of the wear-resistant material in the same measure or to the same degree in which open pores are disappearing because of wear. Therefore as a whole, the number of open pores, and therefore the surface structure, remains approximately the same until finally at the end of its service life, the whole surface layer of the thread delivery orifice is worn out. However, because it is possible to choose the thickness of the surface layer, it is possible to adjust the duration of the uniform function of the thread delivery orifice to the service life of the whole open-end spinning device.

In accordance with an added feature of the invention, there is provided material disposed in the pores being less wear-resistant than the surface layer.

In accordance with an additional feature of the invention, the areas include material from the group consisting of carbon and iron or the material in the pores is formed of carbon or iron.

The insular inclusions in the pores form soft spots which wear faster than the actual surface layer. Insular spots of material which are bounded by the grain boundaries, break off during the wear process, and form open pores. To prepare for the spinning operation, the surface of the thread-delivery orifice, and its surface layer, is first smoothened and polished. Therefore in the case of filled pores, the wearing material is removed faster than the wear resistant parts, and in the case of insular spots bounded by the grain boundaries, these islands break off, and leave open pores behind. The surface structure so created remains intact during the spinning operation. The wear process caused by the running thread corresponds to the polishing operation in the beginning.

In accordance with a concomitant feature of the invention, the wear-resistant surface layer is at least partly formed of material from the group consisting of carbides, borides and silicides (boron or silicide compounds), especially iron, chromium, nickel, titanium, molybdenum and tungsten.

Layers of boron-carbide, or silicon carbide can be used advantageously. Through the use of the hereinafore-described smoothening and polishing, an optimal surface structure for the spinning operation is obtained which on the average remains approximately the same during the whole service life of the thread delivery orifice.

Other features which are considered as characteristic for the invention are set forth in the appended claims.

Although the invention is illustrated and described herein as embodied in an open-end spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic cross-sectional view, partly broken away, of an open-end spinning device; and FIG. 2 is an enlarged cross-sectional view of the thread delivery orifice of the spinning device of FIG. 1.

Referring now to the figures of the drawing and first particularly to FIG. 1 thereof, there is shown a rotor housing 11, and a spinning rotor 12 disposed in the rotor housing, with a rotor shaft 13 extending outward from the rotor housing 11. The rotor housing 11 is closed by a housing cover 14, including a seal 15. The housing cover 14 is removable. The cover 14 is provided with a fiber-feeding channel 16, a thread delivery orifice 17, and a thread delivery channel 18. The thread delivery channel 18 lies in the interior of an intermediate part 19 into which a thread delivery tube 20 opens.

During operation, the spinning rotor 12 rotates by means of the shaft 13. Due to the negative pressure in a ring channel 21 surrounding the rotor housing 11, air flows in through the fiber-feeding channel 16, which transports the spinning fibers into the rotor groove 22 of the spinning rotor 12 in the conventional manner. From there, the twisted or turned thread 23 (shown in FIG. 2) is pulled through the thread delivery channel 18, and the thread delivery tube 20. The direction of the thread path changes approximately 90 degrees in the thread delivery orifice.

It can be seen, especially from FIG. 2, that the thread delivery orifice 17, which basically is made of steel, is provided with a surface layer 25 made of a wear resistant material comprising pores 24 at the places where it deflects the thread to a different direction. The pores 24 contain an attrition material, i.e. a material that wears more readily, which is distributed like islands in the layer 25. The size of these particles of the attrition material which are in this island-like arrangement, can be smaller than indicated in FIG. 2, down to a microscopic smallness.

The aim is to achieve a very uniform distribution, and well distributed size of the insularly arranged particles, or material islands of the wear-proof material, which are also limited by grain size. This is assured, for example, by the previously mentioned borides, silicides or carbides.

The invention is not limited to the described and illustrated embodiment. Within the scope of the disclosed invention, other different embodiments are also possible.

Deviating from the representation in the drawing the surface coating according to the invention can have a lesser or a greater layer thickness in proportion to the size of the basic body. Depending on the method of manufacture, it is also permissible to coat the whole thread delivery orifice up to a quasi homogeneous material transformation. It should be understood that included under the term coating is not only a layer on an existing substrate, but rather also a material transformation, which goes from the surface downward. Finally, also included in the scope of protection should be the borderline case wherein the whole thread delivery orifice is formed of the wear resistant material which is provided with pores or islands or spots of material which are defined by grain boundaries.

There is claimed:

1. Open-end spinning device, comprising a rotor housing, a spinning rotor disposed in said rotor housing, a housing cover having a fiber feeding channel formed therein being in communication with said rotor, a thread delivery channel disposed in said cover, and a thread delivery orifice being at least partly disposed in said cover and being in communication with said thread delivery channel and rotor, said orifice having a hard and wear-resistant surface layer at thread deflection locations, said surface layer having areas of different wearability distributed therein, and said areas of different wearability being insular granular islands having distinct boundaries of random and irregular contour and size.

2. Open-end spinning device, comprising a rotor housing, a spinning rotor disposed in said rotor housing, a housing cover having a fiber feeding channel formed therein being in communication with said rotor, a thread delivery channel disposed in said cover, and a thread delivery orifice being at least partly disposed in said cover and being in communication with said thread delivery channel and rotor, said orifice having a hard and wear-resistant surface layer at thread deflection locations, said surface layer having pores formed therein forming areas of different wearability.

3. Open-end spinning machine according to claim 2, including material disposed in said pores being less wear-resistant than said surface layer.

4. Open-end spinning device according to claim 2, wherein said areas include material from the group consisting of carbon and iron.

5. Open-end spinning device according to claim 3, wherein said material disposed in said pores includes material from the group consisting of carbon and iron.

6. Open-end spinning device according to claim 1, wherein said wear-resistant surface layer is at least partly formed of material from the group consisting of carbides, borides and silicides.

7. Open-end spinning device according to claim 1, wherein said wear-resistant surface layer is at least partly formed of material from the group consisting of iron, chromium, nickel, titanium, molybdenum and tungsten.

8. Open-end spinning device, comprising a rotor housing, a spinning rotor disposed in said rotor housing, a housing cover having a fiber feeding channel formed therein being in communication with said rotor, a thread delivery channel disposed in said cover, and a thread delivery orifice being at least partly disposed in said cover and being in communication with said thread delivery channel and rotor, said orifice having a hard and wear-resistant surface layer at thread deflection locations, said surface layer being formed of iron boride and having pores formed therein.

* * * * *